United States Patent [19]

Paulus

[11] 4,267,416

[45] May 12, 1981

[54] CONTACT ARRANGEMENT FOR VACUUM SWITCH

[75] Inventor: Irmo Paulus, Erlangen, Fed. Rep. of Germany

[73] Assignee: Siemens Aktiengesellschaft, Berlin and Munich, Fed. Rep. of Germany

[21] Appl. No.: 928,689

[22] Filed: Jul. 27, 1978

Related U.S. Application Data

[63] Continuation of Ser. No. 778,266, Mar. 16, 1977, abandoned.

[30] Foreign Application Priority Data

Mar. 30, 1976 [DE] Fed. Rep. of Germany ..... 2613567

[51] Int. Cl.[3] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,980,850 | 9/1976 | Kimblin | 200/144 B |

FOREIGN PATENT DOCUMENTS

| | | | |
|---|---|---|---|
| 1095638 | 12/1967 | United Kingdom | 200/144 B |
| 1098862 | 1/1968 | United Kingdom | 200/144 B |
| 1210600 | 10/1970 | United Kingdom | 200/144 B |
| 494790 | 2/1976 | U.S.S.R. | 200/144 B |

*Primary Examiner*—Robert S. Macon

*Attorney, Agent, or Firm*—Kenyon & Kenyon

[57] ABSTRACT

A contact arrangement for a vacuum switch having contacts movable relative to each other containing slots and provided with an annular seat in which the contact part connecting the contact seat to an electrical conductor forms a hollow body of revolution, the outer surface of which is provided with slots inclined with respect the axis of revolution and the inside surface of which is shaped so as to drive the base of the arc toward the annular seat.

4 Claims, 2 Drawing Figures

CONTACT ARRANGEMENT FOR VACUUM SWITCH

This is a continuation, of application Ser. No. 778,266 filed Mar. 16, 1977 now abandoned.

BACKGROUND OF THE INVENTION

This invention relates to contact arrangements for vacuum switches with contacts which are movable relative to each other in general and more particularly to an improved contact arrangement.

The interruption process in vacuum switch gear is initiated by the separation of cooperating contacts at which time a metal vapor arc is produced. The shape of the contacts which are movable relative to each other is selected so that the intrinsic magnetic forces of the current to be interrupted form a force component in the azimuthal direction which sets the arc in a rotating motion so that the burn off of the contacts is limited. In the known contacts, this is accomplished by special running surfaces for the arc, which surface may form, at the same time, the seating surfaces of the contacts. The running surfaces for the arc may also surround the contact surfaces themselves and may be provided with slots so that the current paths in the contacts follow a predetermined direction. In order for the arc bases to rotate on the running surfaces, the slots generally have an approximately spiral shape relative to the axis of rotation of the contacts. However, such slots are difficult to produce.

Contact arrangements for vacuum switches which have cup shaped contacts are also known. The annular rim of the cup shaped contacts form the seating surfaces of the contacts. The outer surface of the hollow cylindrical cup is provided with slots which run in the radial direction and are inclined to the axis of revolution of the contact. In one particular embodiment of the contact, the rim of the cup is not provided with slots, so that the seating surfaces of the contacts consist of a solid annular part. The bottom of the cup which extends parallel to the seating surface, forms a sharp corner with the cylinder surface. In such cup contacts, the base of the arc can travel from the seating surface at the rim of the cup to the bottom of the cup and dwell there. The result is increased burn off of the contact material at these parts of the contact. (German Auslegeschrift 1 196 751).

The annular parts of such contacts for vacuum switches adjacent to the seating surfaces have also been provided with slots and the ring has been connected to the current leads with braces. These braces then have a conical shape. Since they are not slotted, they disturb the component of the azimuthally directed magnetic force. In addition, the fabrication of this contach is relatively difficult and its mechanical strength is limited by the braces. (Cf. Ueber die Elecktrodenerosion beim Schalten grosser Wechselstroeme im Hochvakuum (On the electrode erosion in switching large a-c currents in a high vacuum); Dissertation by F. C. Althoff, Technical University Braunschweig, 1970).

SUMMARY OF THE INVENTION

It is an object of the present invention to provide a contact arrangement for vacuum switches in which the base of the arc is kept in rotating motion by the intrinsic magnetic forces at the seating surface.

According to the present invention, this problem is solved with a contact part, connecting the contact seat to an electrical conductor, which forms a body of revolution, which is provided with slots inclined with respect to the axis of revolution and the inside surface of which is shaped so as to drive the base of the arc toward the annular seat. The body of revolution can be designed in the shape of a hollow sperical section, or that of a hollow cone, provided with slots inclined with respect to the axis of the cone. One embodiment, for instance, is a truncated hollow cone, the inside terminal surface of which is formed by the end face of a connecting conductor. Through this design, the base of an arc which has left the annular seat, is driven back to the latter, so that it cannot burn at a corner. The intrinsic magnetic forces of the current in the parts of the surface formed by the slots make the base of the arc rotate at the annular seating surface.

DETAILED DESCRIPTION OF THE INVENTION

Figure 1:
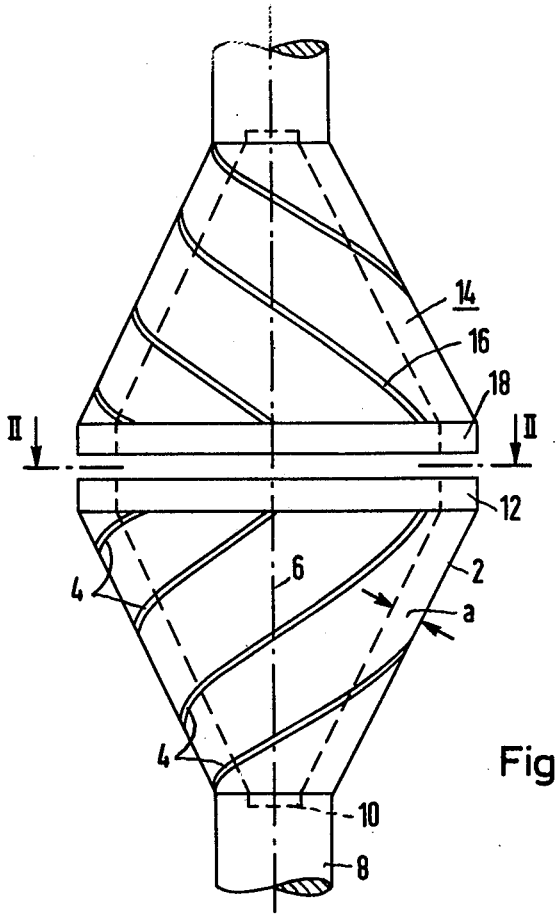
FIG. 1 is a schematic side view of one embodiment of a contact arrangement.

As shown in FIG. 1, the outside surface of a truncated hollow cone 2 with a thickness a of at least a few millimeters, e.g., 5 mm, is provided with slots 4, all of which extend substantially in the radial direction and are inclined with respect to the axis of revolution 6 of the cone. The surface 2 of the cone forms a truncated cone; the inner terminating surface is formed by the end face of a current lead 8. The inner terminating surface of the truncated cone, i.e., the exposed part of the end face of current lead 8, can preferably be provided with an inset 10 of a material with low vapor pressure, e.g., molybdenum or tungsten. The current lead 8 as well as the cone surface 2, on the other hand, generally will consist of copper. At its exposed, open end, the cone surface 2 is provided with an annular contact seat 12, which forms the seating surface of the contact. For reasons of increased strength of the contact, this annular contact seat 12 will generally not be slotted. The seat 12 may also form part of the cone surface 2 and be fabricated integrally with the latter as a body of revolution.

A contact 14 structured in the said manner is arranged coaxially with the first contact in such a manner that the contact seating surface of its annular seat faces toward the annular seat 12. In the contact 14, the angle of the slots 16 can preferably be chosen so that the slots 14 and 16 are arranged in a mirror image relationship to each other in the operating position shown. They thereby form force components of the intrinsic magnetic fields which have azimuthal directions with respect to the annular seats 12 and 18 and which are opposed to each other, so that the arc bases rotate on the contact seating surfaces in opposite directions.

Figure 2:
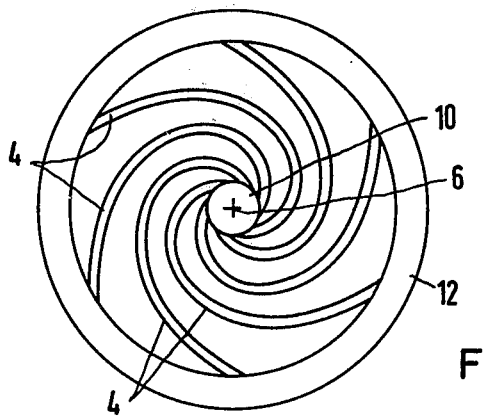
FIG. 2 is a view looking into a hollow cone according to FIG. 1.

In the top view of FIG. 2, it can be seen that the individual slots 4 run in the shape of a spiral. They start at the terminating plate 10 of the cone surface 2 and terminate at the annular seat 12, so that the seating surface of the contact visible in the figure forms a closed, unslotted ring.

What is claimed is:

1. A contact for a vacuum switch including a pair of opposed contacts, each comprising a hollow body of revolution having an axis of revolution, said body of revolution having a plurality of slots extending in a spiral with respect to said axis of revolution; a solid annular contact seat at the base of said body of revolution forming a contact surface; and an electrical lead conductor connected to said body of revolution.

2. The contact according to claim 1 were in said hollow body of revolution comprises a hollow cone.

3. The contact according to claim 1 were in said hollow body of revolution comprises a hollow spherical section.

4. A contact according to any one of claims 1, 2 or 3 and further including an insert of a metal selected from group consisting of molybdenum and tungsten at the end of said electrical lead conductor, at the point where it is connected to said hollow body of revolution.

* * * * *